US006230981B1

(12) United States Patent
Hill et al.

(10) Patent No.: US 6,230,981 B1
(45) Date of Patent: May 15, 2001

(54) STEEL RAILROAD SLEEPERS

(75) Inventors: Kerry Hill, Cockermouth; Sidney Relph, Workington, both of (GB)

(73) Assignee: Corus UK Limited (GB)

( * ) Notice: Subject to any disclaimer, the term of this patent is extended or adjusted under 35 U.S.C. 154(b) by 0 days.

(21) Appl. No.: 09/147,732

(22) PCT Filed: Aug. 27, 1997

(86) PCT No.: PCT/GB97/02292

§ 371 Date: Jun. 11, 1999

§ 102(e) Date: Jun. 11, 1999

(87) PCT Pub. No.: WO98/09022

PCT Pub. Date: Mar. 5, 1998

(30) Foreign Application Priority Data

Aug. 28, 1996 (GB) ..... 9617918

(51) Int. Cl.[7] ..... E01B 21/04
(52) U.S. Cl. ..... 238/54; 238/60
(58) Field of Search ..... 238/54, 59, 60, 238/61

(56) References Cited

U.S. PATENT DOCUMENTS 2,841,338 * 7/1958 Fairbert ..... 238/54

FOREIGN PATENT DOCUMENTS

K09351 9/1910 (GB) .
333 761 9/1930 (GB) .
WO 94 28245 12/1994 (WO) .

OTHER PUBLICATIONS

Patent Abstracts of Japan, vol. 12, No. 347 (M–743), Sep. 19, 1988 & JP 63 108920 A (Takayoshi, May 13, 1988.
Patent Abstracts of Japan, vol. 7, No. 79 (M–204) (Kawasaki Seitetsu KK), Jan. 14, 1983.

* cited by examiner

*Primary Examiner*—S. Joseph Morano
*Assistant Examiner*—Robert J. McCarry, Jr.
(74) *Attorney, Agent, or Firm*—Blank Rome Comisky & McCauley, LLP

(57) ABSTRACT

A steel railroad sleeper of inverted channel section whose open ends can selectively be closed by end plates detachably connected one to open end of the sleeper and whose sides incline downwardly and outwardly from the upper rail supporting surface of the sleeper, the sleeper being produced by cold forming strip steel. The sleeper may be produced by cold pressing or cold rolling and the end plates may also be produced by cold forming steel strip. In one embodiment the sleeper has a waisted section of reduced width. This waisted section may be positioned generally midway along the length of the sleeper. The central section of the sleeper interior may be filled with a material to prevent the ingress of ballast to this central region.

12 Claims, 2 Drawing Sheets

STEEL RAILROAD SLEEPERS

This invention relates to steel railroad or railway sleepers and to methods of producing such sleepers.

Sleepers are integral parts of flexible support systems used for guiding trains. Their key functions are to retain the gauge and inclination of the rails which they support and to assist to maintain both lateral and vertical tolerances placed on the track. They also transmit loads to a supporting bed of ballast over a surface area which is significantly greater than that applied by a wheel of a train and are required to do so in such a manner as to enable the ballast to spread the transmitted load onto the subsoil below the ballast bed without deformation of that subsoil. Sleepers are required to maintain rail track stability during the passage of trains and to maintain this stability notwithstanding temperature changes, this latter feature being more important when continuously welded track is employed.

A minor proportion of sleepers currently employed are produced from steel, these providing lower installation costs than more conventional sleepers of concrete or timber. Steel sleepers are generally of box or inverted channel section and are relatively easy to transport having a higher stacking density, require less expensive equipment to instal, have no need for re-ballasting and require less ballast depth because of their shape. Their use results in shorter and predictable track possession times, and their relatively light weight makes them easier to handle and instal than the more conventional solid concrete or timber sleepers. Also, they are less susceptible to gauge spread and derailment damage and can be repaired; they also have a scrap value.

Conventional steel sleepers are produced by hot forming which results in relatively high manufacturing costs. Increased initial tamping is required to achieve consolidation.

Although a desirably high resistance to lateral movement is achieved, steel sleepered track is more difficult to move during realignment schemes.

A steel box-section sleeper is disclosed by DE-A-2951272. The open ends of this sleeper are closed by welded steel plates or mouldings of reinforced concrete or plastics. The hollow interior of the box-section is filled with an insulating material, for example a mix of cement and water or a rubber elastomer.

WO 89/10450 discloses a steel railroad sleeper of inverted channel section which includes restraining elements attached to and dependent from the underside of the upper supporting surface of the sleeper. These elements include downwardly oriented branches which, in use of the sleeper, provide lateral stability for the sleeper.

Both of the disclosed sleepers suffer from the disadvantages discussed above.

The present invention sets out to provide a sleeper which overcomes, or at least alleviates, some of the disadvantages referred to above.

According to the present invention in one aspect there is provided a steel railroad sleeper of inverted channel section and end plates for selectively closing the open ends thereof, substantially vertically downward movement of the end plates being detachably connectable one to each open end of the sleeper and the sides of the sleeper inclining downwardly and outwardly from an upper rail supporting surface of the sleeper, the sleeper being produced by cold forming strip steel.

The end plates may be latchable into position.

The sleeper may be produced by cold pressing or cold rolling. The end plates may also be produced by cold forming steel strip.

The depth of each end plate may exceed the depth of each side of the sleeper.

The sleeper and/or end plates may be produced from mild or stainless or HSLA steel. If produced from stainless steel, shot peening or anti-corrosion coatings may be effected or provided, to counter any stress corrosion.

The free end of each side of the sleeper may be turned outwardly and upwardly to define a lip.

An opening may be provided in the top of each end plate through which ballast can pass. Alternatively or additionally, the sleeper may be formed at or adjacent one or each end with an opening through which ballast can pass.

The sleeper may have a waisted section of reduced width. This waisted section may be positioned generally midway along the length of the sleeper.

The central section of the sleeper interior may be filled with a material to prevent the ingress of ballast to this central region. The material may be a sound deadening material and may comprise expanded polyurethane foam. Alternatively or additionally, the internal walls of the sleeper may be at least partially coated with a sound deadening material.

In a further aspect, the invention provides a method of producing a steel railroad sleeper of open-ended inverted channel section and end plates therefor, the method comprising the steps of cold forming steel strip to the required inverted channel section and to the required end plate dimensions, and providing on each end plate and/or each open end of the sleeper fittings for securing the end plates to close the open ends of the sleeper, said fittings enabling substantially vertically downward attachment of the end plate to the sleeper.

In another aspect, the invention provides a railroad sleeper of inverted channel section produced by cold forming steel strip, end plates detachably secured one to each open end of the sleeper to close the same, a rail supported by the upper surface of the sleeper and a spring steel clip which secures the rail to the sleeper, the clip including a first bearing surface for engagement with the upper surface of the sleeper, a second bearing surface for engagement with the underside of the rail supporting surface of the sleeper, and a loop section intermediate the first and second bearing surfaces which, in use, engages the upper surface of a foot flange of the rail, and including tool means for applying a force to the internal surfaces of the loop section of the clip to increase the separation thereof whereby the required engagement of the bearing surfaces with the rail and the loop section of the clip with the rail flange is facilitated after the insertion of insulation material between the opposed surfaces of the loop and the rail flange and relaxation of the force applied by the tool.

The insulation material is preferably preformed to complement the upper surface of the rail flange.

In a still further aspect, the invention provides a method of attaching a rail to a sleeper of inverted channel section produced by cold forming steel strip and including detachable endplates using a spring steel clip, the method comprising the steps of positioning a shoulder of the clip in engagement with the sleeper with a bearing surface of the shoulder in contact with the underside of the rail bearing surface of the sleeper adjacent to the edge, positioning a second bearing surface of the clip in contact with the upper surface of the sleeper, positioning a loop section of the clip intermediate the shoulder and second bearing surface with its underside above a foot flange of the rail, inserting into the loop a spreading tool and operating the same to increase the mouth of the loop thereby increasing the separation between the loop and the rail flange, inserting between the loop and the rail flange a preformed insulator, and relaxing the spreader tool to cause the two bearing surfaces firmly to engage the sleeper and the loop firmly to engage the rail flange.

The clip may be generally "U" shaped in plan with each leg of the "U" defining the first mentioned bearing surfaces and a loop section and with the central section of the "U" defining second bearing surfaces.

The invention will now be described by way of example only with reference to the accompanying diagrammatic drawings in which.

Figure 1:
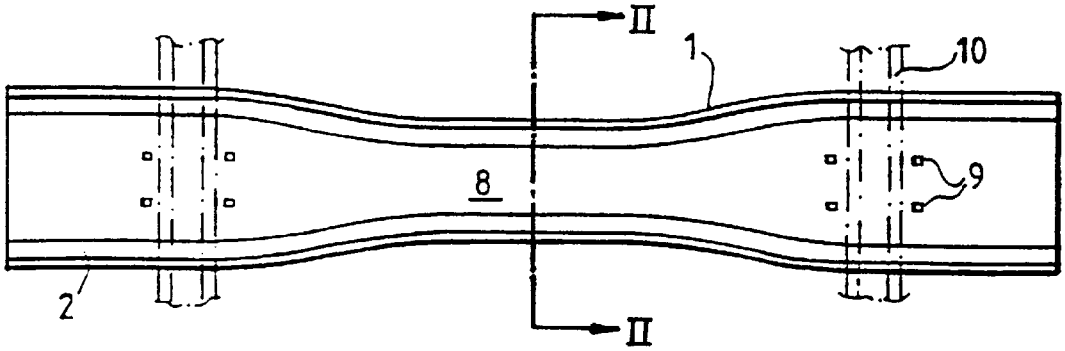
FIG. 1 is a plan view of a sleeper in accordance with the invention.
Figure 2:
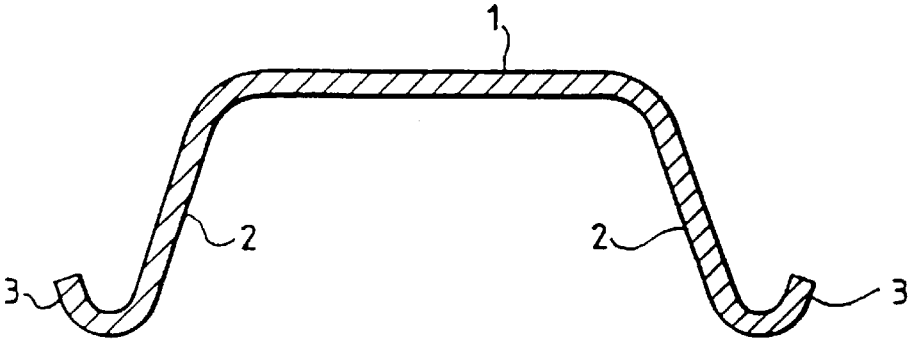
FIG. 2 is a section taken along line II—II of FIG. 1.

As will be seen from FIGS. 1 and 2, the illustrated sleeper 1 when in use is of inverted channel section and is open-ended. The sides 2 of the sleeper are inclined downwardly and outwardly to provide the necessary face angle to establish the required stability and resistance to vertical pull-out. The face angle is also selected to increase stackability density without creating friction which would lead to sticking of neighbouring stacked sleepers. The depth of each side is greater than with more traditional hot rolled products to increase ballast encapsulation. Each longitudinal side of the sleeper is turned outwardly and upwardly to define a lip 3 to increase stiffness and vertical pull-out resistance.

Figure 4:
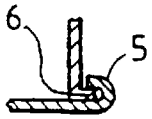
FIG. 4 is a sectional view to an increased scale of a detail of the sleeper and end plate shown in FIG. 3.
Figure 3:
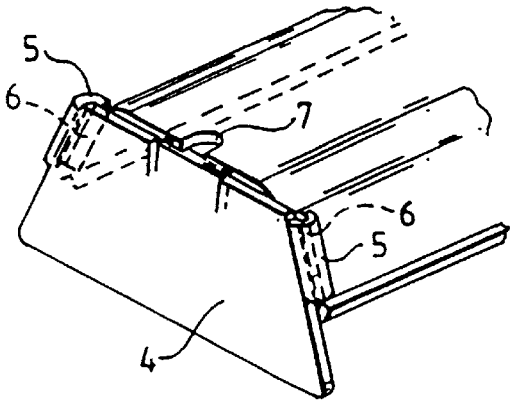
FIG. 3 is an end view in perspective of the sleeper shown in FIGS. 1 and 2 with a selectively removable end plate in position.

As will be seen from FIGS. 3 and 4 the open ends of the sleeper are closed by separable substantially vertical end plates 4 which are detachably secured to the sleeper through locating lugs 5 formed on each side of each end plate which interlock with locking tabs 6 formed along each end edge of the sleeper. Assembly of the end plates to the sleeper is accomplished either automatically or by using a special hand tool. The end plates can, therefore, only be removed by using special tooling, thereby rendering them tamper-proof. Openings 7 are formed in the end plates or in the sleeper ends to enable ballast to be injected into the sleeper interior. As shown, these openings comprise slots formed in the free edges of the upper rail supporting surface of the sleeper.

As will be seen from FIG. 1, the sleeper has a central section 8 which is waisted. This waisting creates greater locking of ballast propelled into the sleeper interior and reduces the amount of ballast necessary to fill the sleeper interior. Sound deadening material may be applied to some or all internal surfaces of the sleeper and similar material may be positioned within the central section 8 not only to deaden sound but also to prevent the ingress of ballast into this central rail section. One suitable material is an expanded foam of, for example, polystyrene.

Holes 9 are stamped into the upper surface of the sleeper to receive attachment clips for securing rails to the sleeper. These will be described below with reference to FIGS. 5 to 8. The positions of rails to be supported by the sleeper are shown in chain dotted lines 10.

As will be seen from FIG. 3, each end plate 4 extends downwardly a greater distance than the side walls 2 of the sleeper thereby improving lateral stability and reducing shoulder ballast while permitting ready realignment of the sleeper simply by removing the end plates.

The inverted channel section of the sleeper is produced by cold forming steel strip. In one exemplary production method, strip from a down coiler is passed through a leveller before shearing to size for cold forming. Sleepers may be so formed individually or as multiples, either in the longitudinal or transverse direction of the strip. Material discarded during shearing may be passed to a secondary forming press for the production of the end plates 4. Alternatively, the end plates may be produced by cold forming suitable shaped steel strips. The end lugs 5 and tabs 6 are produced by special tooling and supplementary operations.

Avoidance of welding during the manufacturing process minimises cost.

When installing sleepers in accordance with the invention on a prepared ballast bed, each sleeper can, because of its shape and open-ends, simply be slid into place. Accurate placement of the sleepers can, therefore, be more readily achieved. Alternatively, sleepers with end plates already fitted can be placed conventionally on a suitable spread ballast bed.

Prior to fitting the end plates to the sleeper, ballast can be blown into the sleeper through its open ends at the optimum pressure to fill all cavities under the inclined regions of the sleeper. This avoids the need for extra tamping required for traditional steel sleepers. As a consequence, ballast life is enhanced, damage from tamping being avoided. If the end plates 4 are already installed, ballast can be blown into the sleeper interior through the openings 7.

As mentioned previously, holes 9 are stamped in the upper surface of the sleeper 1 to receive attachment clips to secure the rails 10 to the sleeper. The sleeper may be shot peened in the vicinity of the holes 9 to enhance the residual stress pattern and integrity. This arrangement enhances the benefit of sliding sleepers into place because all protrusions are eliminated.

Figure 5:
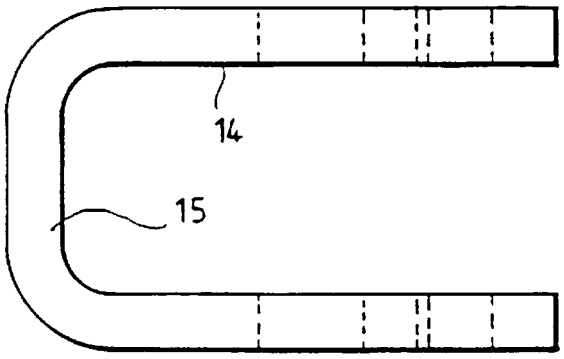
FIGS. 5 and 6 are plan and side views respectively of an attachment clip for securing a rail to the sleeper shown in FIG. 1.
Figure 6:
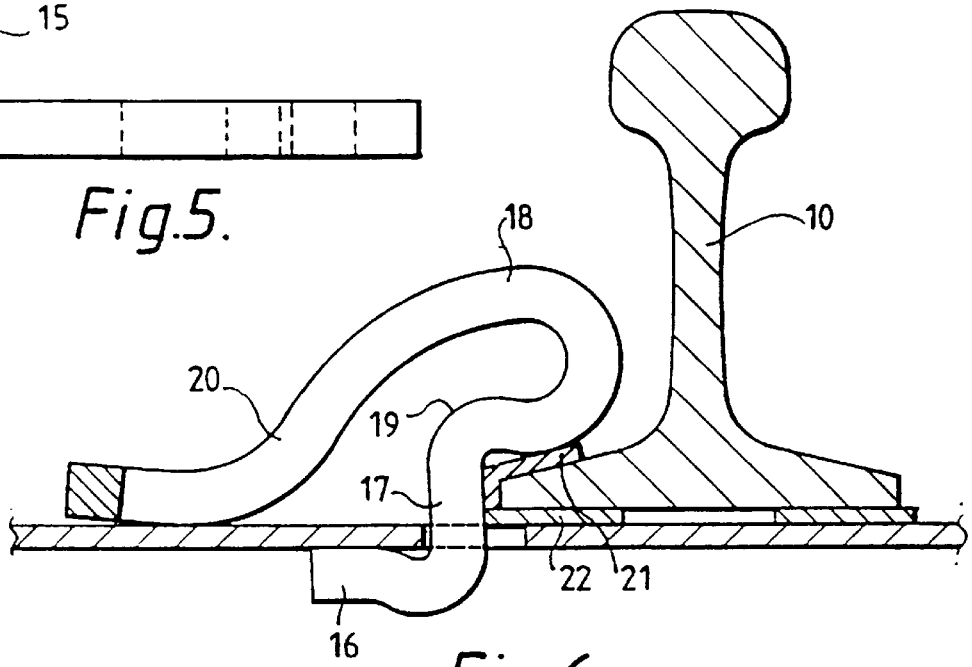

The attachment clip shown in FIGS. 5 and 6 takes the form of a clip manufactured from a spring steel of rectangular cross-section. Other cross-sections such as circular or oval may be adopted. As seen from FIG. 5, in plan view the fastening is generally of "U" shape and comprises a pair of arms 14 joined to a central section 15 set generally normal to the arms.

As will be seen from FIG. 6, each arm of the clip is shaped to include sequentially from its free end a shoulder 16 which extends in the direction towards the central section 15, a leg 17 generally normal to the shoulder 16, a loop 18 having a neck 19 and a curved section 20 which leads to the central section 15.

A spreading tool is insertable within the neck 19 and is operable to increase the neck width and to effect elongation of the leg 17.

A rail 10 supported on the sleeper 1 is also illustrated in FIG. 6. A preformed insulator 21 is positioned on the foot flange of the rail 10. The rail seats on a conventional insulation pad 22.

On assembly of the clip to the rail and the sleeper, the spreading tool is then inserted into the neck 19 and operated to increase the neck width and effect elongation of the leg thereby increasing the spacing between the loop and the rail flange. The free end of each arm 14 of the clip is then passed through the respective hole 9 and the clip is moved to the position shown in FIG. 6 in which the shoulder 16 engages the under surface of the sleeper with the leg 17 contacting the hole boundary. In this position the central section 15 of the clip bears against the upper surface of the sleeper and the loop 18 is positioned above the rail flange (the preformed insulator 21 not being present at this time). With the spreader in place the preformed insulator 21 is inserted between the clip and the rail flange. Relaxation and withdrawal of the spreader tool allows a constraining load to be applied to the rail flange and positive alignment to be maintained. No other fixings are required and the clip is simply removed by insertion of the spreading tool into the neck 19 to effect elongation of the leg as discussed above and removal of the preformed insulator. The clip can then be re-used if appropriate.

Other forms and types of clips to that illustrated in FIGS. 5 and 6 may be employed.

Figure 7:
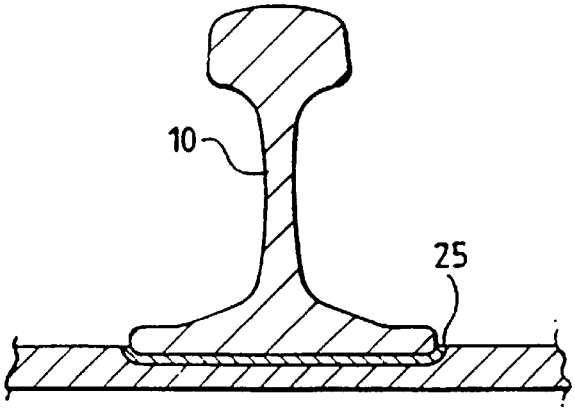
FIGS. 7 and 8 illustrate alternative attachment means in section for securing a rail to a sleeper in accordance with the invention.

In the embodiment illustrated in FIG. 7, the rail 10 is bonded through a combined layer of bonding material insulation 25 within a shallow recess formed in the sleeper upper surface.

Figure 8:
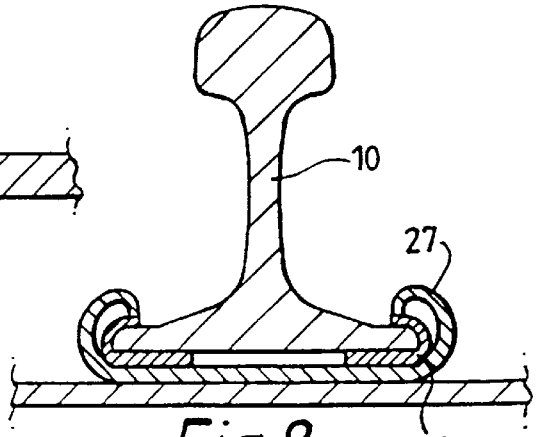

In FIG. 8, the rail 10 is supported within and secured to a spring clip 27 which in turn is bonded to the sleeper surface, possibly within a recess similar to recess illustrated in FIG. 7. The clip may be bolted, welded or bonded to the sleeper, an insulation pad 28 being positioned between the opposed surfaces of the rail flange and the clip.

It will be appreciated that the foregoing is merely exemplary of steel sleepers in accordance with the invention and that modifications and improvements can readily be made thereto without departing from the true scope of the invention as set out in the appended claims.

What is claimed is:

1. A steel railroad sleeper produced by cold forming steel strip and including an open-ended elongate body of inverted channel section having side walls which incline downwardly and outwardly from an upper rail supporting surface and two substantially vertical end plates of greater height than the height of the sleeper body for selectively closing the substantially vertical open ends of the sleeper body, each end edge of the sleeper body and each side edge of each end plate including complementary connection means whereby each end plate can selectively be removed from or attached to the open ends of the sleeper body by effecting sliding movement between the respective end plate and the sleeper body to disengage or engage respectively the complementary connection means.

2. A steel railroad sleeper produced by cold forming steel strip and including an open-ended elongate body of inverted channel section having side walls which incline downwardly and outwardly from an upper rail supporting surface and two substantially vertical end plates of greater height than the height of the sleeper body for selectively closing the substantially vertical open ends of the sleeper body, locking tabs protruding from each end edge of the sleeper body and locating lugs provided along each side edge of each end plate and positioned to receive the locking tabs of the sleeper body, the arrangement being such that each end plate can be selectively removed from or attached to the sleeper body by effecting sliding movement between the respective end plate and the sleeper body to remove the tabs from the lugs or vice versa.

3. A steel railroad sleeper of inverted channel section produced by cold forming strip steel and end plates for selectively closing the open ends thereof, the end plates being detachably connected one to each open end of the sleeper and the sides of the sleeper inclining downwardly and outwardly from an upper rail supporting surface of the sleeper, the central section of the sleeper interior being filled with expanded polyurethane foam.

4. A sleeper as claimed in claim 1, 2 or 3 wherein the end plates are produced by cold forming steel strip.

5. A sleeper as claimed in claim 1, 2 or 3 wherein the free end of each side of the sleeper is turned outwardly and upwardly to define a lip.

6. A sleeper as claimed in claim 1, 2 or 3 wherein an opening is provided in the upper part of each end plate through which ballast can pass.

7. A sleeper as claimed in claim 1, 2 or 3 wherein an opening is formed at or adjacent each end of the sleeper through which ballast can pass.

8. A sleeper as claimed in claim 1, 2 or 3 having a waisted section of reduced width.

9. A sleeper as claimed in claim 1, 2 or 3 wherein the waisted section is positioned generally midway along the length of the sleeper.

10. A sleeper as claimed in claim 1, 2 or 3 wherein the central section of the sleeper interior is filled with a material to prevent the ingress of ballast to this central region.

11. A sleeper as claimed in claim 1 or 2 wherein the material comprises expanded polyurethane foam.

12. A railroad sleeper of inverted channel section produced by cold forming steel strip, end plates detachably secured one to each open end of the sleeper to close the same, a rail supported by the upper surface of the sleeper and a spring steel clip which secures the rail to the sleeper, the clip including a first bearing surface for engagement with the upper surface of the sleeper, a second bearing surface for engagement with the underside of the rail supporting surface of the sleeper, and a loop section intermediate the first and second bearing surfaces which, in use, engages the upper surface of a foot flange of the rail, and including tool means for applying a force to the internal surfaces of the loop section of the clip to increase the separation thereof whereby the required engagement of the bearing surfaces with the rail and the loop section of the clip with the rail flange is facilitated after the insertion of insulation material preformed to complement the upper surface of the rail flange between the opposed surfaces of the loop and the rail flange and relaxation of the force applied by the tool.

* * * * *